US006910689B2

(12) United States Patent
Carolan

(10) Patent No.: US 6,910,689 B2
(45) Date of Patent: Jun. 28, 2005

(54) PRECISION PAPER REGISTRATION USING A STEPPER MOTOR WITHOUT EMPLOYING MICRO-STEPPING TECHNIQUES

(75) Inventor: Kevin M. Carolan, Webster, NY (US)

(73) Assignee: Xerox Corporation, Stamford, CT (US)

( * ) Notice: Subject to any disclaimer, the term of this patent is extended or adjusted under 35 U.S.C. 154(b) by 126 days.

(21) Appl. No.: 10/651,415

(22) Filed: Aug. 29, 2003

(65) Prior Publication Data

US 2005/0067771 A1 Mar. 31, 2005

(51) Int. Cl.[7] ..... B65H 7/02
(52) U.S. Cl. ..... 271/228
(58) Field of Search ..... 271/228

(56) References Cited

U.S. PATENT DOCUMENTS 5,090,683 A * 2/1992 Kamath et al. ..... 271/227
5,094,442 A * 3/1992 Kamprath et al. ..... 271/227
5,172,907 A * 12/1992 Kalisiak ..... 271/227
5,794,176 A * 8/1998 Milillo ..... 702/150
5,848,344 A * 12/1998 Milillo et al. ..... 399/395
6,059,285 A * 5/2000 Suga et al. ..... 271/228
6,269,995 B1 * 8/2001 Rich et al. ..... 226/17
2002/0145249 A1 * 10/2002 Acquaviva et al. ..... 271/228

* cited by examiner

*Primary Examiner*—Donald F. Walsh
*Assistant Examiner*—Kenneth W. Bower
(74) *Attorney, Agent, or Firm*—Perman & Green, LLP.

(57) ABSTRACT

A method and system for correcting paper registration skew. A skew or paper registration error of a sheet moving in a feed path is detected. A coarse adjustment, or copy paper registration, using full steps is performed until the registration error is reduced to a minimum value, below a full step. The frequency of one motor with respect to the other, or a reference, or reference motors, is adjusted for a fixed period to enable a fine adjustment to correct the registration error.

17 Claims, 7 Drawing Sheets

PRECISION PAPER REGISTRATION USING A STEPPER MOTOR WITHOUT EMPLOYING MICRO-STEPPING TECHNIQUES

BACKGROUND

1. Field

The disclosed embodiments generally relate to the positioning of sheets in a feed path and in particular to paper registration using a stepper motor without employing micro-stepping techniques.

2. Brief Description of Related Developments

A translating electronic registration (TELER) system is a method of registering copy paper or documents. It generally includes three optical sensors, a pair of coaxial independently driven drive rolls, a carriage with a linear drive on which paper drive rolls are mounted, and a microprocessor controller. A copy sheet is driven into the nip rolls and moved through the paper path for placement and fusing of an image thereon. The speed of both nip rolls can be controlled to effect skew alignment and longitudinal registration. The nip rollers are mounted on a carriage movable transversely with respect to the feed path. A sensor system controls positioning of the carriage to achieve the desired top edge or a lateral positioning of the sheet. Independent control of nip roll drive and carriage translation provides simultaneous alignment in lateral and longitudinal directions. A translation electronic registration system of this type is disclosed in U.S. Pat. No. 5,094,442 to Kamprath et al. issued Mar. 10, 1992, the disclosure of which is incorporated by reference herein.

A stepper motor can be used to translate the driver rollers. In the TELER system, one of the two stepper motors must be advanced or retarded by a variable number of whole and partial steps to compensate for paper skew and lead edge registration. This is generally accomplished using micro-stepper or high performance DC servo systems that are very costly. Generally, stepper motor registration control designs require costly micro-stepping circuits and techniques. It would be helpful to perform precision paper registration using a stepper motor without employing micro-stepping techniques.

SUMMARY

In one aspect the disclosed embodiments are directed to a method of correcting paper registration and skew. In one embodiment, the method comprises moving a sheet in a feed path and detecting a skew and/or a paper lead edge registration error. A coarse adjustment of the speed of at least one of the motors on the drive roll is made until the skew or registration error is reduced to a minimum value. The speed of at least one of the drive motors with respect to a reference is then adjusted for a fixed period of time or steps, to enable a fine adjustment to correct the skew and/or lead edge registration error.

In another aspect, the disclosed embodiments are directed to a method of positioning a sheet in a feed path. In one embodiment the method comprises detecting the movement and positioning of the sheet in the feed path. This can include detecting the skew positioning, lateral positioning and longitudinal positioning of the sheet in the feed path. A positioning device adapted to compensate for paper skew and lead edge registration error is controlled by increasing or decreasing the velocity of at least one drive roller in the positioning device by an amount with respect to a constant reference for a fixed number of motor steps to advance or retard a position of the roller(s) with respect to the reference by a fractional step.

In a further aspect, the disclosed embodiments are directed to a method of performing paper registration using a stepper motor on the drive roll. In one embodiment the method comprises programming the stepper motor to perform a coarse adjustment and adjusting a frequency of the stepper motor to increase or decrease the speed of the stepper motor(s) to achieve a fine adjustment of the registration error.

In another aspect, the disclosed embodiments are directed to a system for adjusting paper registration skew. In one embodiment the system comprises first and second sheet drive rolls mounted in a feed path for rotation about axes transverse to the feed path. The system also includes a first motor for driving the first drive roll and a second motor for driving the second drive roll and at least one sensor to detect a paper positioning error. A controller is used to determine a step period adjustment to be applied to the second motor with respect to the first motor to correct the error and adjust a frequency of the second motor to correspond to the step period adjustment over a predetermined time period. At the end of the predetermined time period the frequency of the second motor is re-adjusted to the reference frequency. A change in the frequency of the second motor causes a shift in the paper positioning equivalent to the step period adjustment. The fractional adjustment may also be applied to both motors with respect to a reference for lateral registration adjustment. In the case of the disclosed embodiments the reference would be a clock related to the image on the photoreceptor.

BRIEF DESCRIPTION OF THE DRAWINGS

The foregoing aspects and other features of the disclosed embodiments are explained in the following description, taken in connection with the accompanying drawings, wherein.

DETAILED DESCRIPTION OF THE PREFERRED EMBODIMENT(s)

Figure 1:
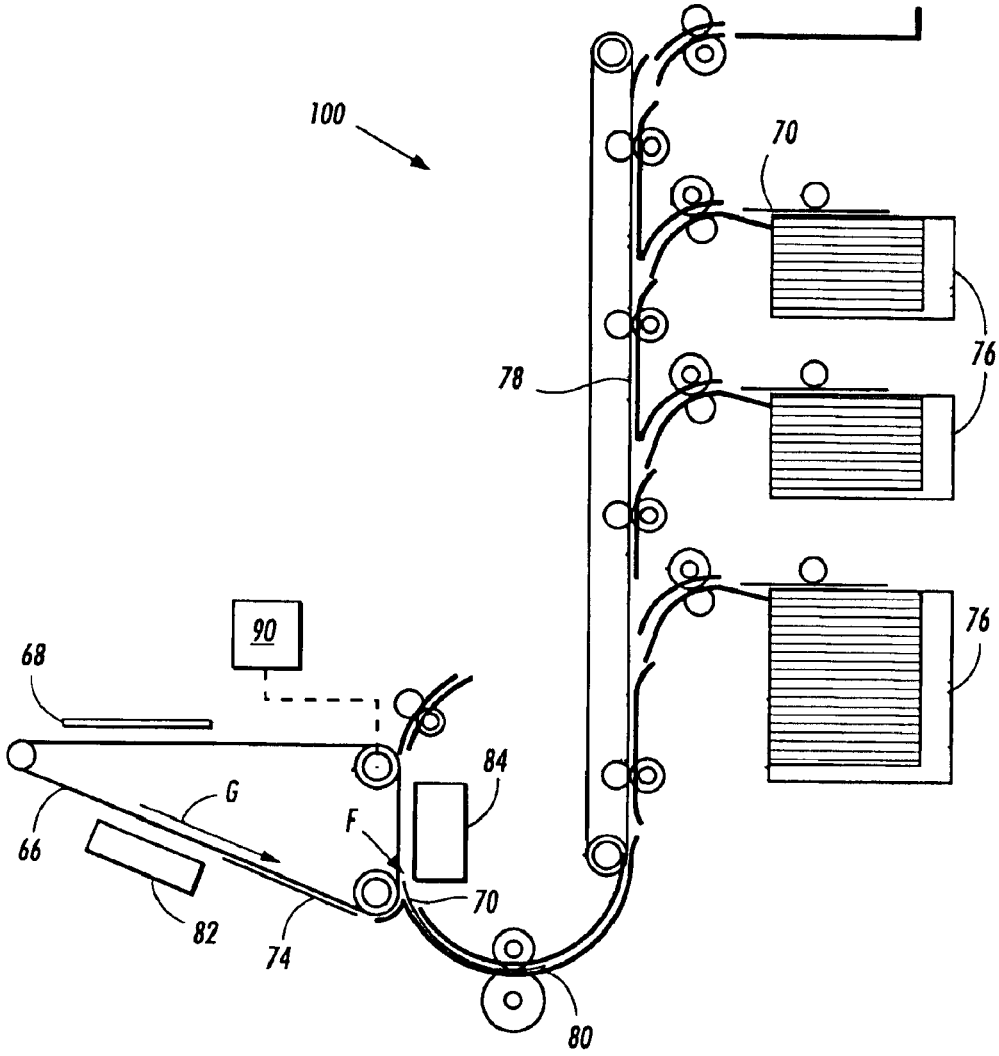
FIG. 1 is an isometric view of a sheet registration system incorporating features of the disclosed embodiments.

Referring to FIG. 1, an isometric view of a system 100 incorporating features of the disclosed embodiments is illustrated. Although the features will be described with reference to the embodiments shown in the drawings, it should be understood that the features can be embodied in many alternate forms of embodiments. In addition, any suitable size, shape or type of elements or materials could be used.

FIG. 1 illustrates a partial interior cavity of a photocopy system 100 in which features of the disclosed embodiments can be practiced. In a paper processing system such as a photocopier or printing machine for example, the positioning of the paper is important for proper placement of the image. The disclosed embodiments provide for correcting or compensating for paper skew and/or lead edge registration errors, also described generally herein as positioning or registration errors, by adjusting the speed of one or both motor(s) with respect to a reference over a period of time to advance or retard the motor(s) with respect to the reference by a fractional step. A "step" as used herein generally relates to revolutions of the motor. For example, when using a 200 step per revolution motor, one step is 1/200 of a revolution of the motor. The revolution of the motor is related to the position of the paper as will be further described herein. Generally however, the motor is connected to a roller that drives the paper by a timing belt. Thus, one step of the motor is related to a linear movement of the paper that is contracted by the roller. Although a 200 step per revolution motor is used herein as an example, any suitable motor can be used, including other than a 200 step per revolution motor.

In FIG. 1, a photoreceptor 66 is shown with latent images 68 and developed images 74 shown thereon. The relative positions of the development station 82 and transfer station 84 are also shown, together with the paper path 78 and media storage trays 76. A fusing station (not shown) may also be included. It will be understood by those with skill in the art that the disclosed embodiments can be practiced in any suitable paper moving system, including, but not limited to a multi-function printer copying system or xerographic system.

Some background related to the photocopying process will now be described. As shown in FIG. 1, once the latent image is generated, photoreceptor 66 will move latent image 68 in the direction of arrow G. Toner particles are deposited onto it at development station 82, thereby transforming latent image 68 into a developed image 74. Photoreceptor 66 and developed image 74 will then proceed toward transfer station 84.

Before developed image 74 reaches transfer station 84, a copy sheet 70 will be removed from one of paper trays 76 and transported along paper path 78. Copy sheet 70 will pass through nip 80 between the two rolls at the end paper path 78 to be placed in contact with developed image 74 just as it reaches transfer station 84. Copy sheet 70 with developed image 74 thereon will then move through a pre-fuser transport to a fusing station where the toner image will be permanently affixed to copy sheet 70. It is important for proper placement and alignment of the copy sheet 70 as it moves through at least the transfer station 84 to ensure the proper transfer of an image.

The disclosed embodiments provide a means for ensuring that copy sheet 70 is in proper alignment at the time it reaches transfer station 84. It should be noted that the disclosed embodiments may successfully be used with any electronic drive roll system.

Copy sheets 70 typically pass through one or more sets of drive rolls in order to be placed in contact with photoreceptor 66. Very generally speaking, electronic drive roll systems require the use of electrical signals to control the speed of motors which are attached to these drive rolls. Thus, electrical signals are used to control the rotational velocity of the drive rolls. As indicated above, there are numerous types of electronic drive rolls systems.

Figure 2:
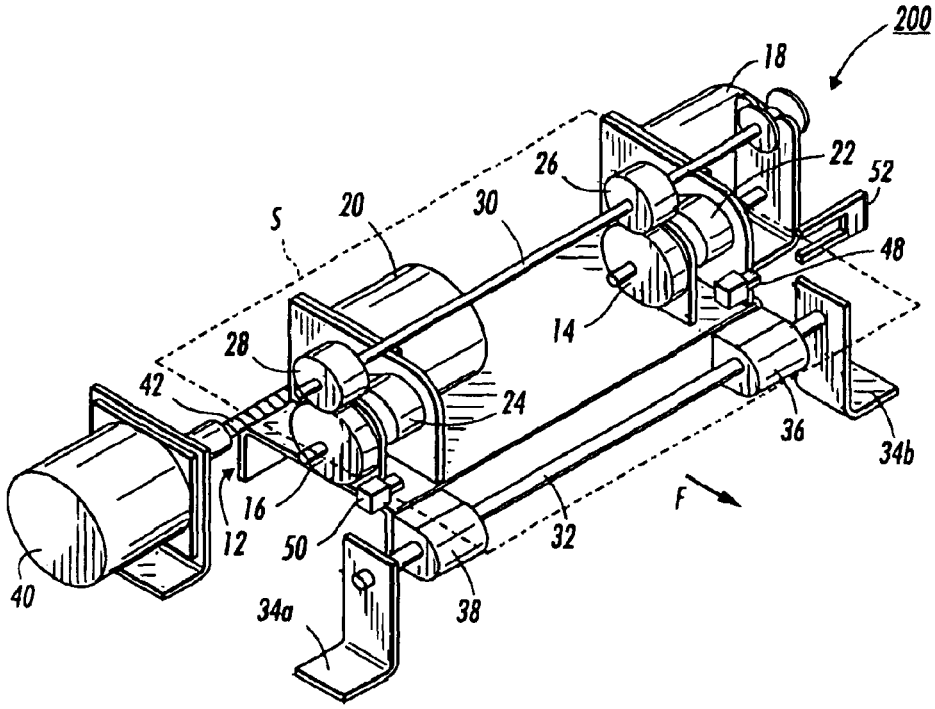
FIG. 2 is a top plan view of the sheet registration system shown in FIG. 1.

One embodiment of an electronic drive roll system 200 is illustrated in FIG. 2. The illustration shows a TELER system such as the one described above. Again, the disclosed embodiments are not limited to use with a TELER system. However, but for discussion purposes herein, this system will be used to describe the operation of at least one embodiment. A TELER registration unit 200 will typically be placed near the end of paper path 78 of FIG. 1 such that roll or roller pairs 14, 26 and 16, 28 of FIG. 2 form nip 80 of FIG. 1 through which copy sheet 70 will pass just prior to reaching transfer station 84.

Figure 3:
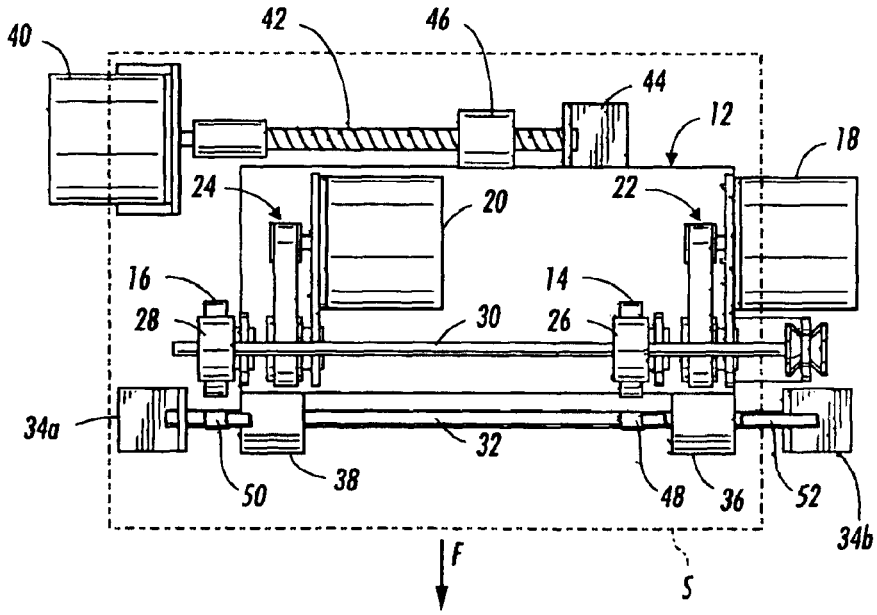
FIG. 3 is a schematic illustration of a sheet positioner showing the placement of sheet location sensors in a system incorporating features of the disclosed embodiments.

Referring to FIG. 1, the system 100 allows precision paper registration using a motor, such as for example a stepper motor on the drive roll without employing micro-stepping techniques. For example, as illustrated in FIG. 1, the copy sheet 70 must be in proper alignment at the time it reaches the transfer station 84. Alignment includes proper paper lead edge registration and skew correction, if any is needed. Generally, referring to FIG. 2, there are two motors 18, 20 used, via the rollers or roll pairs 14, 26 and 16, 28 to control the skew of the sheet 70, one located on each side of the sheet 70. Adjusting a speed of one motor with respect to the other motor, or adjusting the speeds of both motors with respect to a reference, affects the skew of the sheet 70 and can also affect lead edge registration. Thus, for example, using one motor as the reference, the speed of the other motor can be adjusted to correct any skew or alignment problems. However, instead of employing micro-stepping techniques to align the copy sheet 70 with the transfer station, the motor(s), 18 and 20 shown in FIGS. 2 and 3, are programmed to perform a coarse adjustment with full steps until the alignment of the copy sheet 70 is close, or the skew or registration error requires an adjustment that is less than a full step, or, a fractional part of one step. Then, at the end of the coarse adjustment or correction, instead of using micro-steps, the motor(s) 18, 20 are adjusted to increase or decrease the speed of one or both motor(s) with respect to the reference over a fixed period of time or step period to achieve a fine adjustment that is smaller than one step i.e. a fractional adjustment. The fractional adjustment may also be applied to both motors with respect to a reference for lateral registration adjustment. In the case of the described system the reference could be a clock related to the image on the photoreceptor. Adjustment of the speed of the motor(s) can include adjusting a frequency of the motor(s) over a fixed period of time to perform the fine adjustment to reduce or correct the registration error. It is a feature of the disclosed embodiments to increase or decrease the speed of one or both of the motor(s) 18, 20, by a very small amount with respect to a reference, which could be for example, the other motor. The other motor could be used as a constant reference for a fixed number of steps, to advance or retard the position of the adjusted motor with respect to the reference motor by a fractional step. In alternative embodiments, the reference can be any suitable reference other than including a motor, such as for example a clock related to the image on the photoreceptor.

Figure 6:
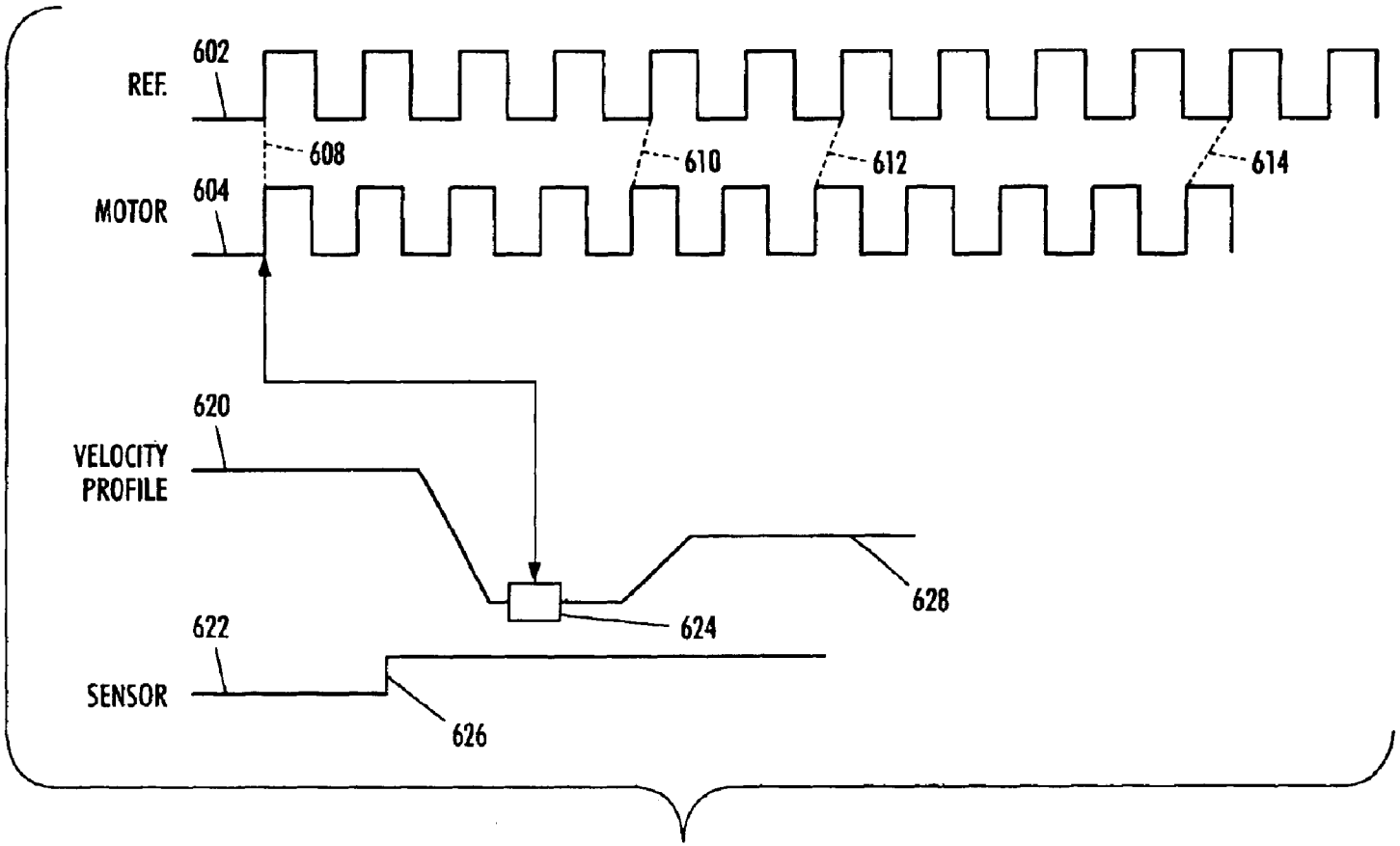
FIG. 6 is a timing diagram for the reference signal and at least one motor to be adjusted in relation to the paper detection system of the registration system incorporating features of the disclosed embodiments.

For example, referring to FIG. 6, if after the coarse adjustment we need to add ½ of a step to a motor 604 that is running at 1000 steps per second, we can increase the motor 604 speed to 1050 HZ for 10 steps. This is a 5% increase in speed for 10 steps. After 10 steps the speed of motor 604 is returned to 1000 steps per second and the adjusted motor 604 is now ½ step ahead of the reference motor 602 and the skew of the paper is adjusted accordingly. If the motor is a 200 step per revolution motor where 1 step is 1/200 of a revolution, the speed of the motor is adjusted for 1/20 of a revolution.

Referring to FIG. 2, the system 200 places a sheet S into proper alignment or registration for downstream processing as the sheet travels in the direction shown by arrow F. The registration unit 200 shown in FIG. 2 includes a carriage 12 having two drive rolls 14 and 16 rotatably mounted thereon by suitable means. The drive rolls 14 and 16 are driven by drive motors 18 and 20, respectively. The drive motors 18 and 20 are preferably speed controllable stepper motors, although other suitable types of motors, such as for example speed controllable servo motors, can be used. The rotary output of each motor 18, 20 is transmitted to the respective drive roll 14, 16 by suitable power transmission means, such as for example belts 22, 24.

Above drive roll 14 there is a nip roll 26 that is rotatably mounted by a suitable means. A similar nip roll 28 is mounted above drive roll 16. Advantageously, the nip rolls 26 and 28 are commonly mounted for rotation about the axis of a cross shaft 30, which is mounted on the carriage 12. The roll pairs 14, 26 and 16, 28 engage the sheet S and drive it through the registration unit 200.

The carriage 12 is mounted for movement transversely of the direction of feed indicated by arrow F. In the arrangement of FIG. 2, this is accomplished by mounting one edge of the carriage 12 on the guide 32, which extends perpendicularly to the direction of sheet feed. The guide 32 is supported on the frame on which the registration system is mounted by a pair of opposed supports 34*a* and 34*b*. The carriage 12 is mounted on the guide 32 by a pair of bearings 36 and 38, which are slidably received on the guide 32.

Referring to FIG. 3, the carriage 12 is moved transversely of the feed path by a drive system including a speed controllable stepper motor 40 or other similar speed controllable servo motor. The output shaft of the motor 40 drives a lead screw 42 which is rotatably supported at the end opposite the motor by a suitable bearing support 44. The motor 40 and support 44 are mounted on the frame of the equipment in which the registration system is used. A block 46 having an internally threaded bore is mounted on the carriage. The threads of the internal bore of the block 46 engage the threads of the lead screw and it will be readily appreciated that as the motor 40 rotates the lead screw 42, the carriage will be driven transversely as the block 46 travels along lead screw 42. The direction of rotation of motor 40 governs the direction of movement of the carriage 12.

Referring again to FIG. 2 the registration system 200 includes detectors for detecting the position of the sheet with respect to the registration system. In one embodiment, the detectors are optical detectors which will detect the presence of edges of the sheet S. In alternate embodiments any suitable detectors can be utilized, other than including optical detectors. For lead edge detection of the sheet, two detectors 48 and 50 are mounted on the carriage 12 adjacent the drive rolls 14 and 16 respectively. The detectors 48 and 50 detect the leading edge of the sheet S as it is driven past the sensors. The sequence of engagement of the sensors 48 and 50 and the amount of time between each detection is utilized to generate control signals for correcting skew (rotational mispositioning of the sheet about an axis perpendicular to the sheet) of the sheet by variation in the speed of the drive rolls 14 and 16.

A top or lateral edge sensor 52 is suitably mounted by means (not shown) on the frame of the equipment on which the registration system is mounted. This optical detector is arranged to detect the top edge of the sheet and the output therefrom is used to control transverse drive motor 40. The basic logic of operation provides that, if the sensor 52 is covered by the sheet, the motor 40 will be controlled to move the carriage to the left (FIG. 2). If, on the other hand, one of the sensors 48, 50 indicates the presence of the leading edge of the sheet, and if sensor 52 remains uncovered, then the motor 40 is driven to move the carriage 12 rightwardly. In one embodiment, the carriage is driven past the transition point, at which the lateral edge of the sheet is detected by the change of state of the sensor 52. Then the drive is reversed to position the lateral edge at the transition point.

Figure 4:
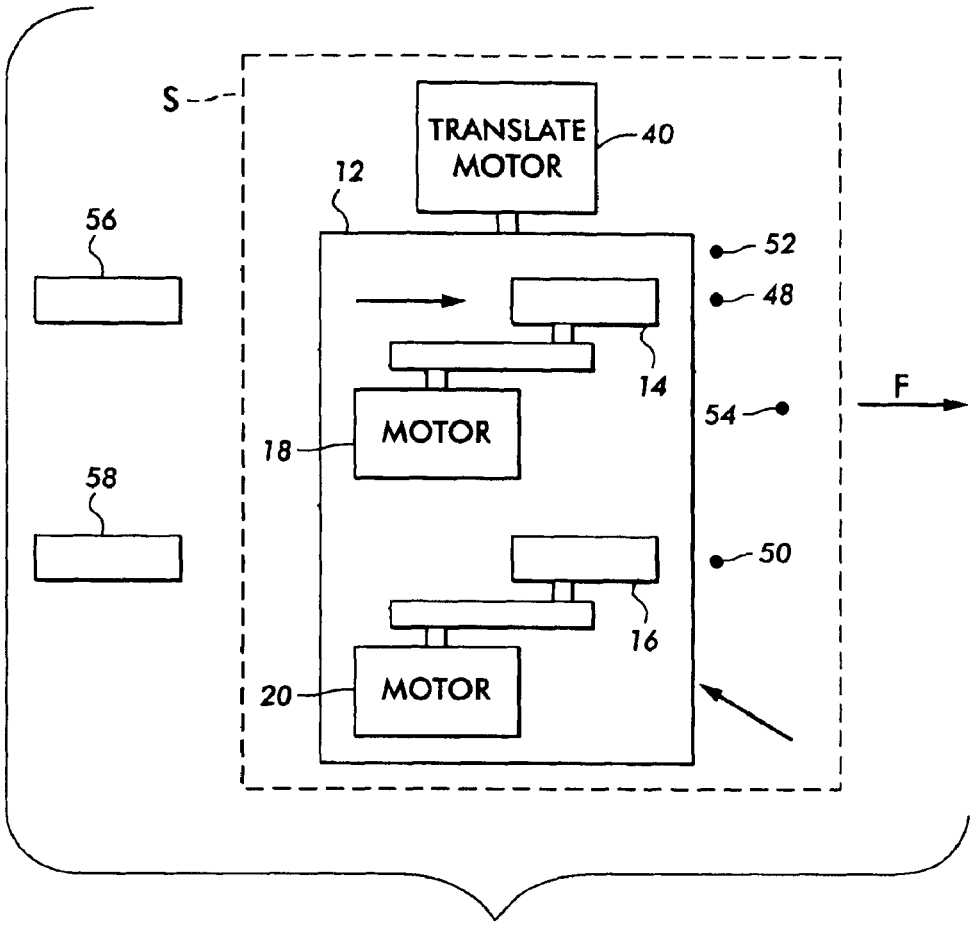
FIG. 4 is a block diagram of control circuitry for one form of sheet registration system incorporating features of the disclosed embodiments.

FIG. 4 is a schematic illustration of a top view of one embodiment of a registration system showing the positioning of the sensors 50, 48, 52. This arrangement shows a fourth sensor 54, which may be an optical sensor, mounted in the feed path of the sheet S to detect the position of the lead edge of the sheet. In one embodiment, the arrival time of the leading edge of sheet S at sensor 54 is compared with a reference signal, for example one occurring after skew correction is complete, to derive a process direction error correction value. This value is compared with a desired value and the velocity of the two drive rolls 14 and 16 is temporarily increased or decreased so that the leading edge of the sheet reaches a desired point in the feed path in synchronization with a downstream operation. In this fashion, the registration system performs a gating function.

In the disclosed embodiments, at the end of the coarse correction, varying the speed of one motor, say for example 18, while the speed of the other motor 20 is kept constant as a reference, the registration or skew correction can be completed by making an adjustment that is smaller than one step or, with a 200 step per revolution motor, less than 1/200 of a revolution. The step period of the motor 18 to be adjusted is varied to either increase or decrease the frequency and speed of the motor 18 over a set time period. At the end of the time period or interval, the speed of the motor 18 is adjusted back to the reference speed (the speed of motor 20). Alternatively, the speed of both motors can be adjusted with respect to a reference to correct the skew and/or lead edge paper registration error.

For example, a stepper motor controller that has a one microsecond (usec) resolution has a step period that is set to 1000 usec. In this example, a 1% change in speed of the motor is equal to 10 usec. Thus, 10 usec×10 steps=100 usecs or 1/10 of a step. If we increase the number of steps to 20, then 10 usec×20 steps=200 usecs or ⅕ of a step. Similarly, if we wish to advance the motor by a fraction of a step count equal to 10, we decrease the step period to 990 usec. If we wish to retard the motor by a fraction of a step, the step period is increased to 1010 usecs. After the required number of steps are reached, the step period reverts back to the original step period, in this case 1000 usecs.

Referring to FIG. 6, an example is shown where the speed of motor 604 is increased by 5% for 10 steps such that after 10 steps the motor 604 is ½ step ahead of the reference motor speed 602. Item 602 represents the command input to a stepper motor amplifier. Each rising edges represents a step. The frequency of the command is proportional to the speed of the motor. Item 604 represents the motor that we want to advance by ½ step with respect to a reference. The reference (602) could be another stepper motor, an internal time base or an encoder in the system. The figure shows that the motor (604) has an increased frequency for 10 steps, such that after the 10 steps the motor is ½ of a step ahead of the reference. Thus, if a sheet is skewed by a fractional part of a step, the increase in speed of motor 604 will move the corresponding edge or side of the paper by a respective amount to correct the skew or registration error. As illustrated at point 608 (the first rising edge), the reference motor 602 and motor 604 are operating at the same frequency (or step period). Then, the frequency of the motor 604 is increased so that its speed is increased (step period is reduced). As shown in FIG. 6, from time reference 608 to time reference 614, the speed of the motor 604 is increased by 5% for 10 steps so that at point 614, after 10 steps, the motor 604 is ½ step ahead of the reference 602. The edge of the paper skews, or moves, a corresponding amount during the change in speed of the motor. When the motor reverts back to its original speed, the alignment or registration error is adjusted.

Also shown in FIG. 6 is a representation of the velocity profile 620 of the motor 604 as detected or measured by the sensor 622. The registration system incorporating the features disclosed herein generally includes two sensors, one on each edge of the paper. Item 624 shows the location for the fractional step correction in the velocity profile of a typical registration application. Sensor 622 shows the start of the registration algorithm at reference 626.

Figure 7:
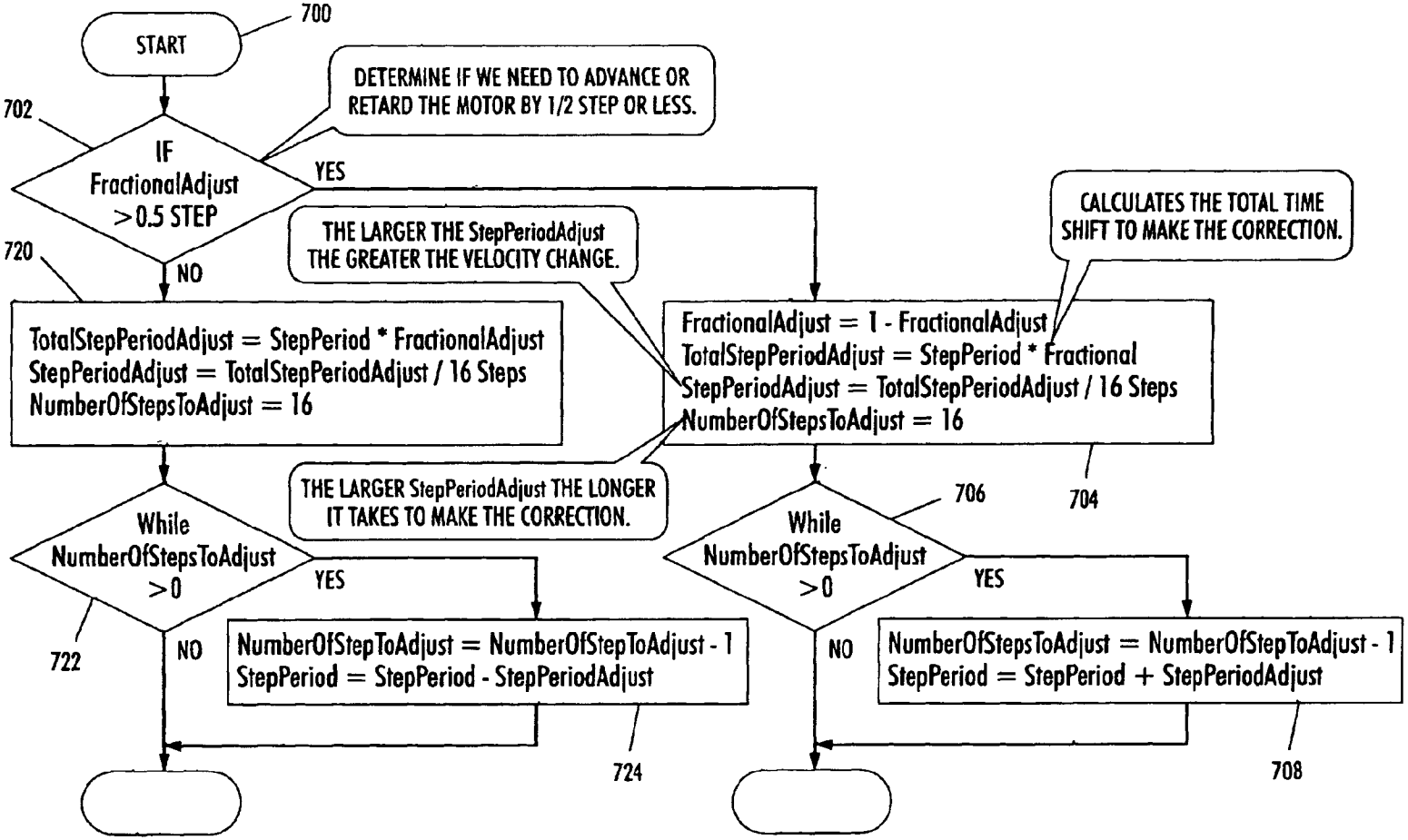
FIG. 7 is a process flow diagram for a paper positioning adjustment system incorporating features of the disclosed embodiments.

Referring to FIG. 7, a flow chart illustrating a method incorporating features of the disclosed embodiments is illustrated.

First, it is determined whether a fine adjustment is needed to correct a paper registration error after a copy registration is performed with full steps, also referred to as a coarse correction. The fractional adjustment of a fractional part of a step to be corrected can be in the range of 0–0.999 steps, with a worst-case adjustment being ½ step. Then, if an adjustment is needed, in step 702 it is determined whether the fractional adjustment needed is greater than 0.5 steps. This can include determining if we need to advance or retard the motor by ½ step or less. In the case where the motor(s) are retarded the registration algorithm will account for an additional full step. If the fractional adjustment is greater than ½ step, a calculation in step 704 is made to determine the number of steps needed to make the adjustment. Although the number of steps used herein is a fixed number of steps, the number of steps could be calculated based on a fixed amount of time required to make the correction. The total step period adjustment or the total time shift needed to make the correction is equal to the step period multiplied by one minus the fractional part of a step to be corrected, or the fractional adjustments. The step period adjustment is equal to the total step period adjustment divided by, for example, sixteen steps. This number can be any suitable or desired number of steps. The more steps, the smaller the velocity difference. The larger the step period adjustment, the greater the velocity change. The smaller the step period adjustment the longer it takes to make the correction.

In step 706 we determine if the number of steps to adjust is greater than zero, which means we have not finished the fractional correction. If so, we proceed to step 708 where we continue to complete the fractional correction. The value of the number of steps to adjust is reduced by one and the step period is increased by the step period adjustment value. This adjusts the speed of the drive motor accordingly.

If, in step 702, the amount of correction needed is less than 0.5 step, we proceed to step 720. For example, we assume here that the amount of correction needed, the fractional adjustment, is 0.25 steps. In step 720, we determine the value of the step period adjustment that will be needed to advance or retard the motor. The Total Step Period Adjustment is the Step Period multiplied by the Fractional Adjustment. In this example, we assume the Step Period to be 1000 microseconds, although any suitable step period can be used as a matter of design choice. Thus, in this example, the Total Step Period Adjustment is 1000 usec×0.25 or 250 usec. The Step Period Adjustment value is the Total Step Period Adjustment divided by the number of steps to adjust. Generally, the number of steps to adjust can be any suitable value. The larger the value for the number of steps, the smaller the velocity difference will be. A greater number of steps might be used where the velocity difference between the two motors or reference 18, 20 is to be minimized. In this example, we have chosen the number of steps to adjust to be sixteen. Thus, the step period adjustment is approximately 15.625 us. In step 724 this value is communicated to the motor and the speed of the motor is adjusted accordingly. In step 722, it is also determined if the number of steps to adjust is greater than zero. If so, we recalculate the step period needed to continue the correction process. First, the number of steps to adjust is reduced by one. Then, a new step period is calculated that is the original step period less the step period adjustment. In this example that is 1000 usec–250 usec/16, or approximately 984.375 usec. This adjusts the step period of the motor that is being advanced. In this case, since the step period is decreasing, the frequency or speed of the motor is increasing. This step period is maintained for the number of steps to adjust and then returns to the step period value previous to the adjustment. Both motors and or the reference 18, 20 are running at the same speed.

Figure 5:
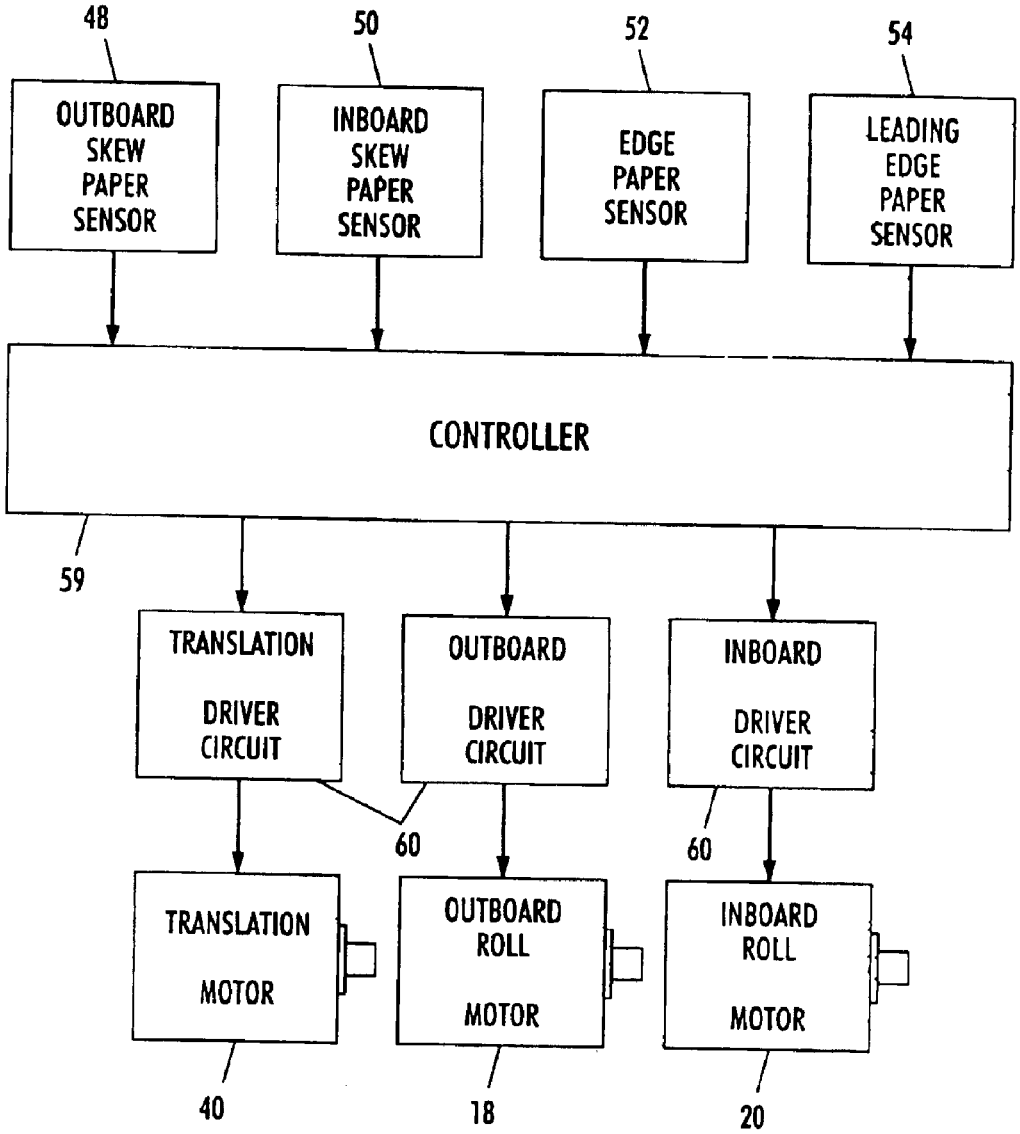
FIG. 5 is a schematic diagram of one embodiment of a control system for a registration system incorporating features of the disclosed embodiments.

For the control of the registration system disclosed above, control systems having the arrangement shown in FIG. 5 are desirable. Signals from the edge sensors 48, 50, 52 and, alternatively sensor 54, are provided to a controller 59. In a preferred arrangement, sensors 48 and 50 are utilized for both skew correction and longitudinal gating. In an alternative arrangement, if higher speed or accuracy is necessary, it may be desirable to employ a fourth sensor 54, for deriving signals necessary for longitudinal gating.

The controller 59 can be a typical microprocessor which is programmed to calculate correction values required and provide control outputs for effecting appropriate action of the stepper motors 18, 20, and 40. Such microprocessor control systems are well known to those of skill in the art and no detailed description thereof is necessary. Outputs of the microprocessor are provided to driver control circuits 60, for controlling speeds and duration of drive of motors 18, 20, and 40. Suitable driver control circuits are known in the art and no further detailed explanation is necessary. In one embodiment the controller 59 includes circuitry and/or software that is adapted to update or change the step in accordance with the process described with reference to FIG. 7. The phase of each motor can be adjusted to vary its frequency and thus, speed. The microcontroller or control circuitry must be capable of a small changes in frequency to allow for a small (example 1% to 10%) velocity increase or decrease. The microcontroller or control circuitry must also be capable of counting the number of steps that the velocity has been increased or decreased.

Figure 8:
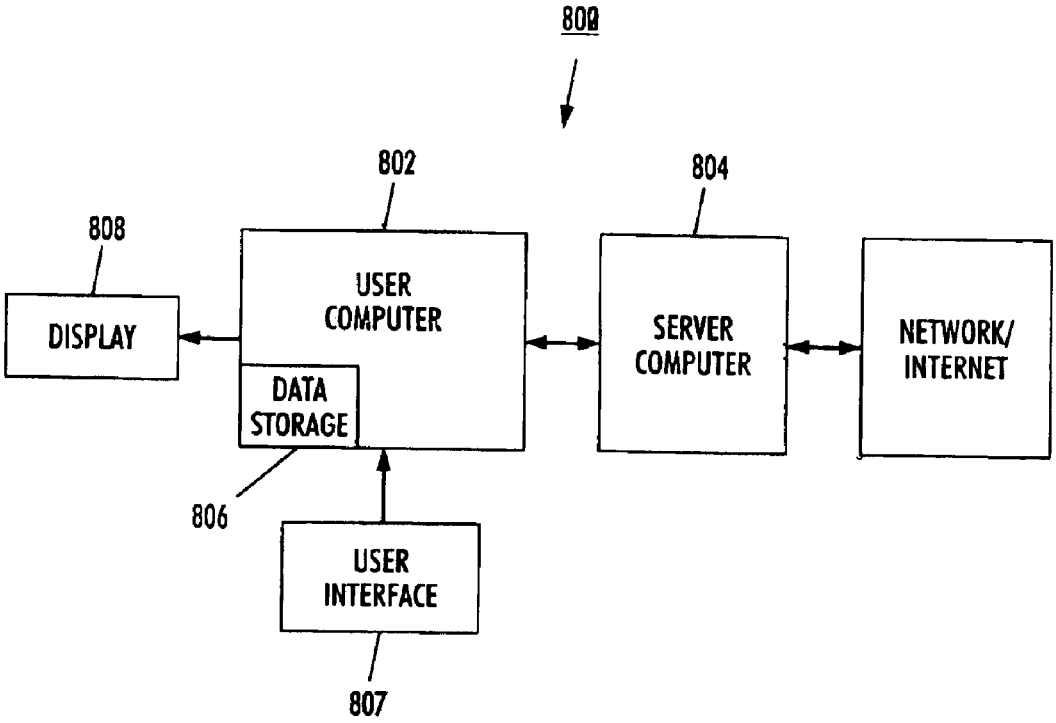
FIG. 8 is a block diagram of an architecture that can be used to implement the features of the disclosed embodiments.

The disclosed embodiments may also include software and computer programs incorporating the process steps and instructions described above that are executed in different computers. In the preferred embodiment, the computers are connected to the Internet. FIG. 8 is a block diagram of one embodiment of a typical apparatus that may be used to practice the features of the disclosed embodiments. As shown, a computer system 802 may be linked to another computer system 804, such that the computers 802 and 804 are capable of sending information to each other and receiving information from each other. In one embodiment, computer system 802 could include a server computer adapted to communicate with a network 804, such as for example, Ethernet or CAN (Control Area Network). Computer systems 802 and 804 can be linked together in any conventional manner including a modem, hard wire connection, or fiber optic link. Generally, information can be made available to both computer systems 802 and 804 using a communication protocol typically sent over a communication channel or through a dial-up connection on ISDN line. Computers 802 and 804 are generally adapted to utilize program storage devices embodying machine-readable program source code which is adapted to cause the computers 802 and 804 to perform the method steps of the disclosed embodiments. The program storage devices incorporating features of the disclosed embodiments may be devised, made and used as a component of a machine utilizing optics, magnetic properties and/or electronics to perform the procedures and methods of the disclosed embodiments. In alternate embodiments, the program storage devices may include magnetic media such as a diskette or computer hard drive, which is readable and executable by a computer. In other alternate embodiments, the program storage devices could include optical disks, read-only-memory ("ROM") floppy disks and semiconductor materials and chips.

Computer systems 802 and 804 may also include a microprocessor for executing stored programs. Computer 802 may include a data storage device 806 on its program storage device for the storage of information and data. The computer program or software incorporating the processes and method steps incorporating features of the disclosed embodiments may be stored in one or more computers 802 and 804 on an otherwise conventional program storage device. In one embodiment, computers 802 and 804 may include a user interface 807, and a display interface 808 from which features of the disclosed embodiments can be accessed. The user interface 807 and the display interface 808 can be adapted to allow the input of queries and commands to the system, as well as present the results of the commands and queries.

While particular embodiments have been described, Various alternatives, modifications, variations, improvements, and substantial equivalents that are or may be presently unforeseen may arise to Applicant's or others skilled in the in the art. Accordingly, the appended claims as filed and as they may be amended are intended to embrace all such alternatives, modifications, variations, improvements and substantial equivalents.

What is claimed is:

1. A method of correcting paper registration and skew comprising:

detecting an alignment error of a sheet moving in a feed path;

adjusting a speed of at least one drive motor associated with the feed path with respect to a reference until the alignment error is reduced to a minimum value; and adjusting the speed of the at least one drive motor with respect to a reference over a fixed period of time to perform a fine adjustment to correct the alignment error.

2. The method of claim 1 wherein the frequency of the at least one motor is changed to increase or decrease the speed of the motor by a small amount.

3. The method of claim 1 wherein the drive motor comprises a stepper motor and the alignment error is corrected without employing micro-stepping techniques.

4. The method of claim 1, wherein the fine adjustment comprises:

determining a step period of a first drive motor and a second drive motor associated with the feed path;

determining a step change need to perform the fine adjustment;

calculating a change in frequency of one or both motors corresponding to the step change needed to perform the fine adjustment;

adjusting a frequency of the one or both motors to the calculated change in frequency for a predetermined number of steps; and readjusting the frequency of one or both motors to an original value after one or both motors execute the predetermined number of steps.

5. The method of claim 1 wherein the fine adjustment comprises a fraction of a revolution of the at least one drive motor.

6. The method of claim 1 wherein the registration error a fraction of a step of the at least one drive motor, the step being a fraction of a revolution of the at least one drive motor.

7. The method of claim 1 wherein if the fine adjustment is greater than one-half of a step, the method further comprises:

determining a period needed to make the fine adjustment by multiplying the step period of the at least one motor by the difference of one less the fractional part of the step to be corrected, applying a step period adjustment to the motor, the step period adjustment comprising the period needed to make the adjustment divided by a predetermined number of steps to make the adjustment;

determining if the number of steps remaining to complete the adjustment is greater than zero, and if so, reduce the number of steps to adjust by one and add the step period adjustment to the motor period.

8. The method of claim 1, wherein if the fine adjustment is less than one-half of a step, determining a value of a period needed to make the fine adjustment by multiplying the step period of the at least one motor by the fine adjustment comprising a fractional part of a step;

applying a step period adjustment to the motor, the step period adjustment comprising the period needed to make the fine adjustment divided a predetermined number of steps to make the adjustment;

determining if the number of steps to complete the adjustment is greater than zero, and if so, reduce the number of steps to adjust by one and substracte the step period adjustment feom the motor period.

9. The method of claim 1 wherein the alignment error is a registration skew error or a lead edge alignment error.

10. A method of positioning a sheet in a feed path comprising:

detecting skew positioning, lateral positioning and longitudinal positioning of the sheet in the feed path; and controlling a positioning device adapted to compensate for skew positioning, lateral positioning and longitudinal positioning of the sheet by increasing or decreasing a speed of the at least one drive roller motor in the positioning device by an amount with respect to a constant reference for a fixed number of motor steps to advance or retard a position of at least one roller associated with the motor with respect to the reference by a fractional step.

11. The method of claim 10 wherein the step of detecting further comprises calculating a step period change required based on a step period of the at least one drive roller motor and a number of steps required to reposition the sheet, over a predetermined period.

12. The method of claim 11 wherein the step of controlling further comprise adjusting a frequency of the at least one drive roller motor for the predetermined period and readjusting the frequency of the drive roller motor to an initial reference frequency.

13. A method of performing paper registration using at least one stepper motor on the drive roll comprising:

programming the at least one stepper motor to perform a coarse adjustment of a position of a sheet in a feed path; and adjusting a frequency of the at least one stepper motor to increase or decrease the speed of the stepper motor to achieve a fine adjustment of the sheet position.

14. The method of claim 13, wherein the speed of the motor is changed a very small amount with respect to a constant reference for a fixed number of steps to advance a position of a portion of the sheet driven by the motor with respect to the reference by a fractional step.

15. The method of claim 13 further comprising, if the amount of remaining correction required is less than ½ step, of:

determining a value of a step period adjustment needed to advance or retard the motor;

determining a total step period adjustment by multiplying a step period of the motor by the fractional adjustment;

adjusting the speed of the motor by a step period adjustment value that is equal to the total step period adjustment divided by a predetermined number of steps, and returning the speed of the motor back to its original speed at the expiration of the predetermined time period.

16. The method of claim 13 further comprising, if the fractional adjustment required is greater than ½ step, of:

determining a time period needed to make the adjustment by multiplying a step period of the motor by the fractional part of the step to be corrected;

determining a step period adjustment to be made to the motor to change the speed of the motor by dividing the time period needed to make the adjustment by a predetermined referenced time period; and adjusting the speed of the motor to make the fractional correction using the step period adjustment.

17. A system for adjusting a position of a sheet in a sheet registration system comprising:

at least first and second sheet drive rolls mounted in a feed path for rotation about axes transverse to the feed path;

at least a first motor for driving the first drive roll and at least a second motor for driving the second drive roll;

at least one sensor to detect at least one sheet positioning error;

a controller adapted to:

determine a step period adjustment to be applied to at least one of the first motor and the second motor with respect to a reference to correct the sheet positioning error;

adjust a frequency of the at least one of the first motor and the second motor to correspond to the step period adjustment over a predetermined number of steps; and at the end of the predetermined number of steps re-adjust the frequency of the at least one of the first motor and the second motor to a reference frequency, wherein a change in the frequency of the at least one of the first motor and the second motor causes a shift in the sheet positioning equivalent to the step period adjustment.

* * * * *